US010417952B2

(12) United States Patent
Yan

(10) Patent No.: US 10,417,952 B2
(45) Date of Patent: Sep. 17, 2019

(54) METHOD FOR DRIVING DISPLAY DEVICE BASED ON INDIVIDUAL ADJUSTMENT OF GRAYSCALES OF MULTIPLE DISPLAY AREAS

(71) Applicant: Wuhan China Star Optoelectronics Technology Co., Ltd., Wuhan, Hubei (CN)

(72) Inventor: Weinan Yan, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 259 days.

(21) Appl. No.: 15/534,624

(22) PCT Filed: Apr. 27, 2017

(86) PCT No.: PCT/CN2017/082113
§ 371 (c)(1),
(2) Date: Jun. 9, 2017

(87) PCT Pub. No.: WO2018/188122
PCT Pub. Date: Oct. 18, 2018

(65) Prior Publication Data

US 2019/0088187 A1 Mar. 21, 2019

(30) Foreign Application Priority Data

Apr. 11, 2017 (CN) ..... 2017 1 0230814

(51) Int. Cl.
*G09G 3/20* (2006.01)
*G09G 5/10* (2006.01)

(52) U.S. Cl.
CPC ..... *G09G 3/2074* (2013.01); *G09G 3/20* (2013.01); *G09G 5/10* (2013.01);
(Continued)

(58) Field of Classification Search
CPC ..... G09G 3/2074; G09G 2310/027; G09G 2330/021; G09G 2320/0626
See application file for complete search history.

(56) References Cited

U.S. PATENT DOCUMENTS

2007/0115213 A1 5/2007 Hsu
2011/0032286 A1* 2/2011 Takata ..... G09G 3/3406 345/690

(Continued)

FOREIGN PATENT DOCUMENTS

CN 101145305 A 3/2008
CN 101231810 A 7/2008

(Continued)

*Primary Examiner* — Ryan A Lubit
(74) *Attorney, Agent, or Firm* — Andrew C. Cheng

(57) ABSTRACT

The present disclosure provides a driving method and a driving device of display devices. The driving device includes an image input unit, an image analyzing unit, an image processing unit, and an image output unit. The image input unit receives image data of each frames to be displayed in sequence. The image analyzing unit divides the received image data of the frame into a plurality of display areas, and calculates pixel grayscale values of the display areas to determine adjustment coefficients of each of the display areas to lower down the pixel grayscale values of the display areas. The image processing unit combines all of the display areas after adjusting the pixel grayscale values to form driving data of the current frame. The image output unit 40 outputs the driving data of the current frame to drive the current frame to be displayed.

6 Claims, 2 Drawing Sheets

(52) U.S. Cl.
CPC ..... *G09G 2310/027* (2013.01); *G09G 2320/0233* (2013.01); *G09G 2320/0271* (2013.01); *G09G 2320/0626* (2013.01); *G09G 2320/0686* (2013.01); *G09G 2330/021* (2013.01); *G09G 2360/16* (2013.01)

(56) References Cited

U.S. PATENT DOCUMENTS

| | | | | |
|---|---|---|---|---|
| 2016/0196793 | A1* | 7/2016 | Xu | G09G 3/3611 345/694 |
| 2017/0294156 | A1* | 10/2017 | Pyo | G09G 3/2077 |
| 2018/0075795 | A1* | 3/2018 | Lin | G09G 3/36 |

FOREIGN PATENT DOCUMENTS

| | | | |
|---|---|---|---|
| CN | 102419955 | A | 4/2012 |
| CN | 103310752 | A | 9/2013 |
| CN | 105976760 | A | 9/2016 |
| CN | 105895054 | A | 8/2018 |

* cited by examiner

METHOD FOR DRIVING DISPLAY DEVICE BASED ON INDIVIDUAL ADJUSTMENT OF GRAYSCALES OF MULTIPLE DISPLAY AREAS

BACKGROUND OF THE INVENTION

1. Field of the Invention

The present disclosure relates to a display technology, and more particularly to a driving method and a driving device of a display.

2. Discussion of the Related Art

A tablet display device has multiple advantages, such as a thin body, power saving, and radiation-free, and tablet display device has been widely used. A conventional tablet display device may be a Liquid Crystal Display (LCD) or a Organic Light Emitting Display (OLED). With development of display technology and improvement of user needs, requirements for a display design and display are getting higher and higher. Further, with improvement of display effect of the display, corresponding problems also arise. One of the corresponding problems is a power consumption problem. For mobile phones, tablet computer, and terminals to rely on batteries, the power consumption problem is more important.

SUMMARY

In view of the shortcomings of the traditional technology, the present disclosure provide a driving method and a driving device of a display to reduce power consumption of the display.

To achieve the foregoing purpose, the present disclosure adopts the following technical scheme:

A driving method of display devices, includes:

dividing received image data of a frame into a plurality of display areas;

respectively adjusting pixel grayscale values of each of the display areas of the current frame to reduce the pixel grayscale values of some of the or all of the display areas;

combining all of the display areas after adjusting the pixel grayscale values to form driving data of the current frame; and outputting the driving data of the current frame to drive the current frame to be displayed.

The driving method further includes:

setting all of sub-pixels of a n-th display area of the current frame as a set;

calculating an average value $G_a(n)$ of the grayscale values in the set;

calculating a variance $G_v(n)$ of the grayscale values in the set;

calculating a root-mean-square-error R(n) of the grayscale value of the current frame being relative to the grayscale value of the driving data of a pervious frame;

when $G_a(n) \geq G_{ath}$, $G_v(n) \geq G_{vth}$, and $R(n) \geq R_{th}$, reducing the pixel grayscale values of the n-th display area;

wherein the $G_{ath}$ is a threshold of the average value of the grayscale values;

wherein the $G_{vth}$ is a threshold of the variance of the grayscale values;

wherein the $R_{th}$ is a threshold of the root-mean-square-error of the grayscale values;

wherein n is a positive integer;

wherein when the current frame is the first frame being inputted, the grayscale value of the driving data of a pervious frame is set as 0.

The driving method further includes:

adjusting the pixel grayscale value of the n-th display area by the following formula:

$$G'_p(n)=f(n)\times G_p(n);$$

wherein the $G_p(n)$ is the pixel grayscale value before adjustment;

wherein the $G'_p(n)$ is the pixel grayscale value after adjustment;

wherein the f(n) is an adjustment coefficient of the n-th display area;

wherein when $G_a(n) \geq G_{ath}$, $G_v(n) \geq G_{vth}$, and $R(n) \geq R_{th}$, $0<f(n)<1$; otherwise $f(n)=1$.

The driving method further includes:

setting an adjustment threshold $\Delta G_0$;

when a grayscale value difference $\Delta G=G_p(n)-f(n)\times G_p(n)>\Delta G_0$, calculating the $G'_p(n)$ by the following formula:

$$G'_p(n)=G_p(n)-\Delta G_0.$$

The display areas includes:

a central area, located on a central position of a displayed image;

a plurality of rim areas, located around the central area;

wherein a dimension of the central area is more than 50% of the dimension of the displayed image.

The present disclosure further provides a driving device of display devices, includes:

an image input unit, configured to receive image data of each frames to be displayed in sequence;

an image analyzing unit, configured to divide the received image data of the frame into a plurality of display areas, and calculate pixel grayscale values of the display areas to determine adjustment coefficients of each of the display areas; wherein the adjustment coefficients of some of the or all of the display areas are configured to lower down the pixel grayscale values of the display areas;

an image processing unit, configured to adjust the pixel grayscale values of the display areas of a current frame according to the adjustment coefficients determined by the image analyzing unit, and combine all of the display areas after adjusting the pixel grayscale values to form driving data of the current frame;

an image output unit, configured to output the driving data of the current frame to drive the current frame to be displayed.

The image analyzing unit includes:

a data saving module, configured to save a threshold of the average value of the grayscale values $G_{ath}$, a threshold of the variance of the grayscale values $G_{vth}$, a threshold of the root-mean-square-error of the grayscale values $R_{th}$, and the driving data of a pervious frame;

an analyzing module, configured to divide the received image data of the frame into the plurality display areas, set all of sub-pixels of a n-th display area of the current frame as a set, calculate an average value $G_a(n)$ of the grayscale values in the set, calculate a variance $G_v(n)$ of the grayscale values in the set, calculate a root-mean-square-error R(n) of the grayscale value of the current frame being relative to the grayscale value of the driving data of a pervious frame, and determine an adjustment coefficient f(n) of the n-th display area by comparing calculation values and thresholds; wherein n is a positive integer;

wherein when $G_a(n) \geq G_{ath}$, $G_v(n) \geq G_{vth}$, and $R(n) \geq R_{th}$, the f(n) is determined to reduce the pixel grayscale value of the n-th display area;

wherein when the current frame is the first frame being inputted, the grayscale value of the driving data of a pervious frame saved in the data saving module is set as 0.

The image processing unit adjusts the pixel grayscale value of the n-th display area by the following formula:

$$G'_p(n)=f(n)\times G_p(n);$$

wherein the $G_p(n)$ is the pixel grayscale value before adjustment, the $G'_p(n)$ is the pixel grayscale value after adjustment, and the f(n) is an adjustment coefficient of the n-th display area;

wherein when $G_a(n) \geq G_{ath}$, $G_v(n) \geq G_{vth}$, and $R(n) \geq R_{th}$, $0<f(n)<1$; otherwise $f(n)=1$.

The image processing unit sets an adjustment threshold $\Delta G_0$;

wherein when a grayscale value difference $\Delta G=G_p(n)-f(n)\times G_p(n)>\Delta G_0$, the image processing unit calculates the $G'_p(n)$ by the following formula:

$$G'_p(n)=G_p(n)-\Delta G_0.$$

The display areas includes:

a central area, located on a central position of a displayed image;

a plurality of rim areas, located around the central area;

wherein a dimension of the central area is more than 50% of the dimension of the displayed image.

Compared to the prior art, the preset disclosure provides the driving method and the driving device of the display devices. Since the received image data of the frame is divided into the multiple display areas and the pixel grayscale values of each of the display areas of the current frame are adjusted, the pixel grayscale values of some of the or all of the display areas are reduced. In other words, luminance of some of particular area is reduced. Therefore, the power consumption is reduced.

In a specific example, the pixel grayscale values are respectively calculated. When an average value of the grayscale values, a variance of the grayscale values, and a root-mean-square-error of the grayscale value of the current frame being relative to the grayscale value of the driving data of a previous frame of one of the display areas are respectively greater than thresholds, the grayscale values of the sub-pixels of the one of the display areas are respectively adjusted by the downgrade adjustment. The luminance of some of the or all of the display areas is selectively reduced while the image observed by the human eye is not affected, and the power consumption is reduced.

DETAILED DESCRIPTION OF THE EMBODIMENTS

Figure 1:
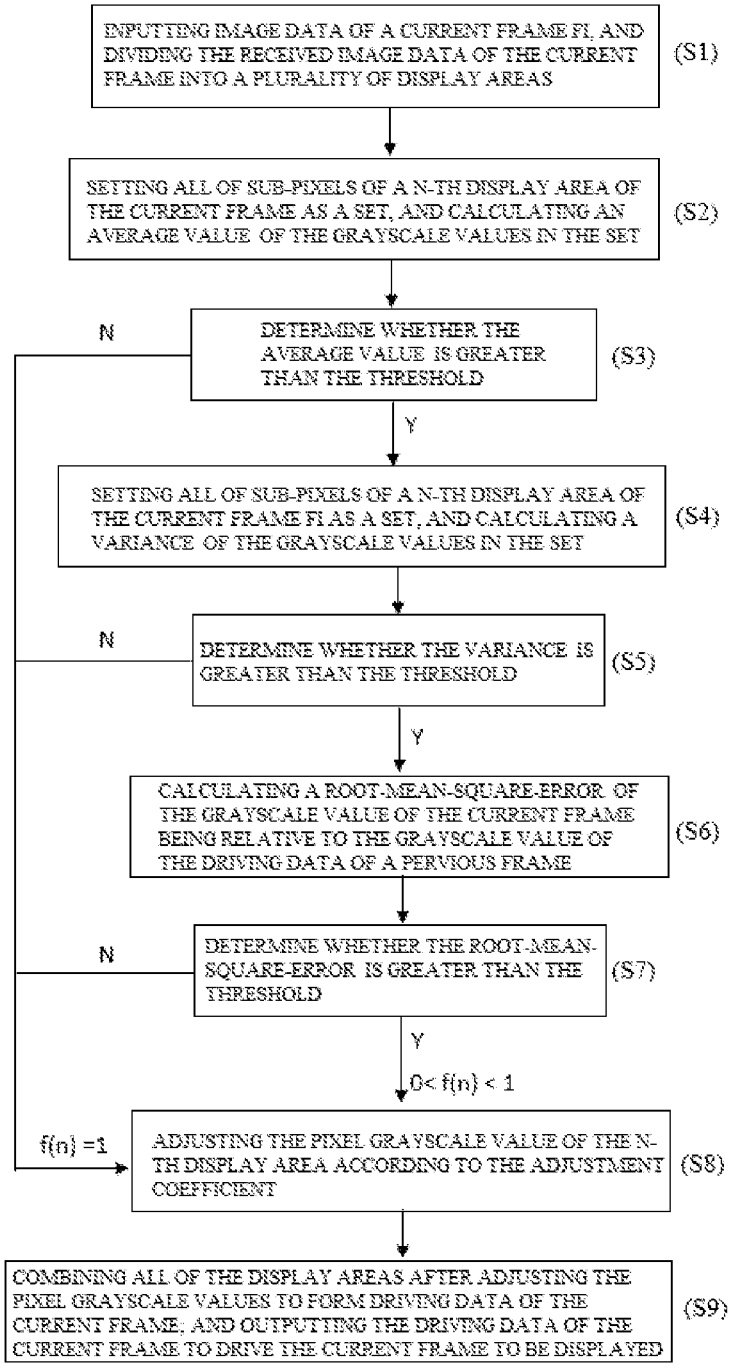
FIG. 1 is a flowchart of a driving method of display devices provided in one embodiment of the present disclosure.

Embodiments of the invention will now be described more fully hereinafter with reference to the accompanying drawings, in which embodiments of the invention are shown.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

An embodiment of the present disclosure provides a driving method of display devices, and the driving method includes:

1. dividing received image data of a frame into a plurality of display areas;

Specifically, the frame to be displayed may be divided into multiple display areas with a same dimension. However, the frame to be displayed may be divided into multiple display areas with different dimensions. Since humans are more concerned about a central area of an image, a dimension of the central area may be greater than dimensions of the other areas of the image. Further, dimensions of rim areas of the image may be smaller than dimensions of the other areas of the image.

2. respectively adjusting pixel grayscale values of each of the display areas of the current frame to reduce the pixel grayscale values of some of the or all of the display areas;

First of all, the pixel grayscale values are respectively calculated. When some of the display areas meet a reduced order condition, the pixel grayscale values of the display areas that meet the reduced order condition may be reduced.

3. combining all of the display areas after adjusting the pixel grayscale values to form driving data of the current frame, and outputting the driving data of the current frame to drive the current frame to be displayed.

Therefore, luminance of some of the or all of the display areas may be reduced, and power consumption of the display device may also be reduced.

Figure 2:
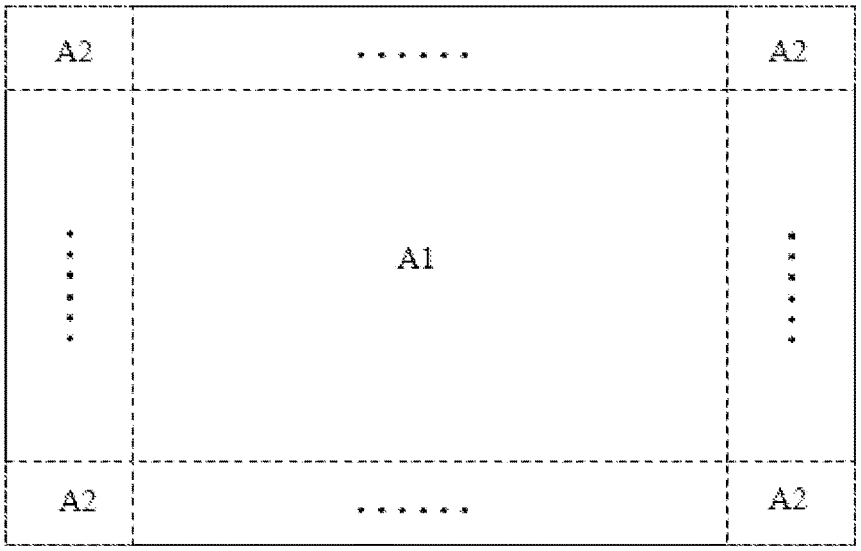
FIG. 2 is a schematic view of dividing a frame into multiple display areas provided in one embodiment of the present disclosure.

Specifically, with reference to FIG. 1, the driving method includes the steps of:

S1: inputting image data of a current frame Fi, and dividing the received image data of the current frame into a plurality of display areas;

With reference to FIG. 2, in the embodiment, a display image is divided into a central area A1 and a plurality of rim areas A2. The central area A1 is located on the display image, and the rim areas A2 are located around the central area A1. A dimension of the central area A1 is greater than dimensions of the rim areas A2, and the dimensions of the rim areas A2 are the same. However, in the other embodiment, the dimensions of the rim areas A2 may be different.

S2: setting all of sub-pixels of a n-th display area of the current frame Fi as a set, and calculating an average value $G_a(n)$ of the grayscale values in the set;

The average value $G_a(n)$ may be calculated by the following formula (1). In the formula (1), $G_{Pj}(n)$ is a grayscale value of the j-th sub-pixel of the n-th display area, and J(n) is a number of the mount of the sub-pixels in the n-th display area.

$$G_a(n) = \frac{\sum_{j=1}^{J} G_{Pj}(n)}{J(n)}; \quad (1)$$

S3: comparing the average value $G_a(n)$ with a threshold $G_{ath}$ of the average value of the grayscale values to determine whether the average value $G_a(n)$ is greater than the threshold $G_{ath}$. When the average value $G_a(n)$ is greater than the threshold $G_{ath}$ ($G_a(n) \geq G_{ath}$), step S4 may be continuously implemented. When the average value $G_a(n)$ is not greater than the threshold $G_{ath}$($G_a(n) < G_{ath}$), an adjustment coefficient f(n) of the n-th display area of the current frame may be 1 (f(n)=1)

S4: setting all of sub-pixels of a n-th display area of the current frame Fi as a set, and calculating a variance $G_v(n)$ of the grayscale values in the set;

The variance $G_v(n)$ may be calculated by the following formula (2). In the formula (2), $G_{Pj}(n)$ is a grayscale value of the j-th sub-pixel of the n-th display area, J(n) is a number of the mount of the sub-pixels in the n-th display area, and $G_a(n)$ is the average value of the grayscale values in the set.

$$G_v(n) = \sqrt{\frac{\sum_{j=1}^{J} [G_{Pj}(n) - G_a(n)]^2}{J(n)}}; \quad (2)$$

S5: comparing the variance $G_v(n)$ with a threshold $G_{vth}$ of the variance of the grayscale values to determine whether the variance $G_v(n)$ is greater than the threshold $G_{vth}$. When the variance $G_v(n)$ is greater than the threshold $G_{vth}$($G_v(n) \geq G_{vth}$), step S6 may be continuously implemented. When the variance $G_v(n)$ is not greater than the threshold $G_{vth}$($G_v(n) < G_{vth}$), the adjustment coefficient f(n) of the n-th display area of the current frame may be 1(f(n)=1).

S6: setting all of sub-pixels of a n-th display area of the current frame Fi as a set, and calculating a root-mean-square-error R(n) of the grayscale value of the current frame Fi being relative to the grayscale value of the driving data of a pervious frame Fi−1;

The root-mean-square-error R(n) may be calculated by the following formula (3). In the formula (3), $G_{Pj}(n, F_i)$ is a grayscale value of the j-th sub-pixel of the n-th display area of the current frame Fi, $G_{Pj}(n, F_{i-1})$ is a grayscale value of the j-th sub-pixel of the n-th display area of the current frame Fi−1, and J(n) is a number of the mount of the sub-pixels in the n-th display area.

$$R(n) = \sqrt{\frac{\sum_{j=1}^{J} [G_{Pj}(n, F_i) - G_{Pj}(n, F_{i-1})]^2}{J(n)}}; \quad (3)$$

S7: comparing the root-mean-square-error R(n) with a threshold $R_{th}$ of the root-mean-square-error of the grayscale values to determine whether the root-mean-square-error R(n) is greater than the threshold $R_{th}$. When the root-mean-square-error R(n) is greater than the threshold $R_{th}$(R(n) $\geq R_{th}$), the adjustment coefficient f(n) of the n-th display area of the current frame may between 0 and 1 (0<f(n)<1) and the adjustment coefficient f(n) may be a constant or an inversely proportional function related to the average value $G_a(n)$. When the adjustment coefficient f(n) is not greater than the threshold $R_{th}$(R(n)<$R_{th}$), the adjustment coefficient f(n) of the n-th display area of the current frame may be 1(f(n)=1).

S8: adjusting the pixel grayscale value of the n-th display area according to the adjustment coefficient f(n);

The pixel grayscale value of the n-th display area may be adjusted by the following formula:

$$G'_p(n) = f(n) \times G_p(n);$$

In the above formula, $G_p(n)$ is the pixel grayscale value of the n-th display area before adjustment, $G'_p(n)$ is the pixel grayscale value of the n-th display area after adjustment, f(n) is an adjustment coefficient of the n-th display area. The pixel grayscale value $G'_p(n)$ of the n-th display area after adjustment is determined by multiplying the pixel grayscale value $G_p(n)$ of the n-th display area before adjustment by the adjustment coefficient f(n).

S9: combining all of the display areas after adjusting the pixel grayscale values to form driving data of the current frame; and outputting the driving data of the current frame Fi to drive the current frame Fi to be displayed.

The above mentioned n, i, j, each are positive integer. Further, when the current frame Fi is the first frame being inputted (i=1), the grayscale value of the driving data of a pervious frame is set as 0.

In the driving method, when $G_a(n) \geq G_{ath}$, $G_v(n) \geq G_{vth}$, and $R(n) \geq R_{th}$, determining 0<f(n)<1 to reduce the pixel grayscale values of the n-th display area; otherwise f(n)=1 to maintain the pixel grayscale values of the n-th display area.

When $G_a(n) \geq G_{ath}$ and $G_v(n) \geq G_{vth}$, the pixel grayscale values are greater, the grayscale values are adjusted by the downgrade adjustment to reduce influence of the image. When $R(n) \geq R_{th}$, the current frame Fi and a pervious frame Fi−1 are very different. When the current frame Fi and a pervious frame Fi−1 are very different, human eye may not obviously sense brightness change. Therefore, the grayscale values are adjusted by the downgrade adjustment to reduce the influence of the image.

When the three conditions, $G_a(n) \geq G_{ath}$, $G_v(n) \geq G_{vth}$, and $R(n) \geq R_{th}$, are maintained, the grayscale values are adjusted by the downgrade adjustment. Therefore, the steps S3, S5, and S7 may be performed in any order. In the other words, $G_a(n)$ may be calculated and compared at first, $G_v(n)$ may be calculated and compared at first, or R(n) may be calculated and compared at first f(n) may be acquired with the same value. The calculation of $G_a(n)$ and $G_v(n)$ may be easier than the calculation of R(n). Therefore, when one of the conditions $G_a(n) \geq G_{ath}$ and $G_v(n) \geq G_{vth}$ may not meet the requirement to be adjusted by the downgrade adjustment, R(n) may not be calculated. Parameters in calculation of $G_v(n)$ may include $G_a(n)$. Therefore, $G_a(n)$ may be calculated and compared at first, $G_v(n)$ may be calculated and compared at second, and R(n) may be calculated and compared finally.

In step S8, to avoid the influence of the image caused by a grayscale value difference, an adjustment threshold $\Delta G_0$ is set. When the grayscale value difference $\Delta G = G_p(n) - f(n) \times G_p(n) > \Delta G_0$, calculating the $G'_p(n)$ by the following formula $$G'_p(n) = G_p(n) - \Delta G_0.$$

Since people have a high degree of attention to a central area of the image, when a dynamic image is displayed, the grayscale of the image rim area may not affect a perception of a user. Therefore, the dimension of the central area A1 is greater than dimensions of the rim areas A2. The greater dimension of an area, the smaller probability to simultaneously achieve $G_a(n) \geq G_{ath}$, $G_v(n) \geq G_{vth}$, and $R(n) \geq R_{th}$, and vice versa. Therefore, the probability to adjust the central area A1 by the downgrade adjustment is smaller, and the probability to adjust the rim areas A2 by the downgrade adjustment is greater. In the embodiment, the dimension of the central area A1 is more than 50% of the dimension of the displayed image.

Figure 3:
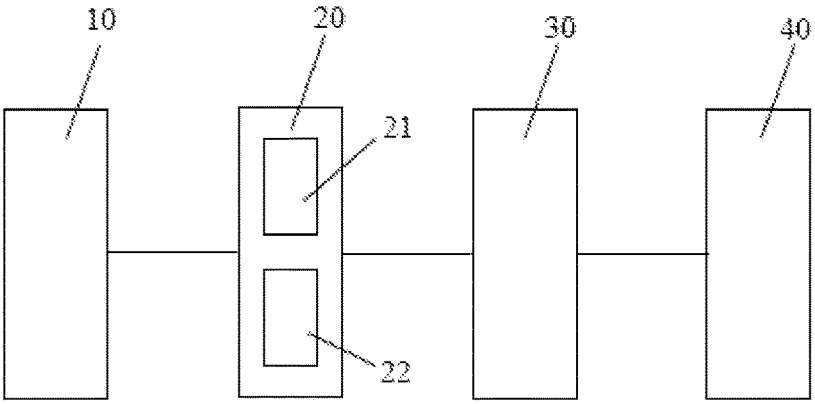
FIG. 3 is a schematic view of a driving device of display devices provided in one embodiment of the present disclosure.

The present disclosure further provides a driving device of display devices. With reference to FIG. 3, and the driving device includes an image input unit 10, an image analyzing unit 20, an image processing unit 30, and an image output unit 40. The driving device executes the driving method to drive a display panel to display an image.

The image input unit 10 receives image data of each frames to be displayed in sequence. The image analyzing unit 20 divides the received image data of the frame into a plurality of display areas, and calculates pixel grayscale values of the display areas to determine adjustment coefficients of each of the display areas. The adjustment coefficients of some of the or all of the display areas are configured to lower down the pixel grayscale values of the display areas. The image processing unit 30 adjusts the pixel grayscale values of the display areas of a current frame according to the adjustment coefficients determined by the image analyzing unit, and combines all of the display areas after adjusting the pixel grayscale values to form driving data of the current frame. The image output unit 40 outputs the driving data of the current frame to drive the current frame to be displayed.

The image analyzing unit 20 includes a data saving module 21 and an analyzing module 22. The data saving module 21 saves a threshold of the average value of the grayscale values $G_{ath}$, a threshold of the variance of the grayscale values $G_{vth}$, a threshold of the root-mean-square-error of the grayscale values $R_{th}$, and the driving data of a pervious frame. The analyzing module 22 divides the received image data of the frame into the plurality display areas, sets all of sub-pixels of a n-th display area of the current frame as a set, calculate an average value $G_a(n)$ of the grayscale values in the set, calculates a variance $G_v(n)$ of the grayscale values in the set, calculates a root-mean-square-error R(n) of the grayscale value of the current frame being relative to the grayscale value of the driving data of a pervious frame, and determines an adjustment coefficient f(n) of the n-th display area by comparing calculation values and thresholds. When $G_a(n) \geq G_{ath}$, $G_v(n) \geq G_{vth}$, and $R(n) \geq R_{th}$, the f(n) is determined to reduce the pixel grayscale value of the n-th display area.

When the current frame is the first frame being inputted, the grayscale value of the driving data of a pervious frame saved in the data saving module 21 is set as 0.

The image processing unit 30 adjusts the pixel grayscale value of the n-th display area by the following formula:

$$G'_p(n)=f(n)\times G_p(n).$$

The $G_p(n)$ is the pixel grayscale value before adjustment, the $G'_p(n)$ is the pixel grayscale value after adjustment, and the f(n) is an adjustment coefficient of the n-th display area.

The image processing unit 30 combines the pixel grayscale values of all of the display area after adjustment to form the driving data of the current frame. The image processing unit 30 outputs the driving data to the image output unit 40 to drive the current frame to be displayed, and saves the driving data into the data saving module 21.

The image processing unit 30 sets an adjustment threshold $\Delta G_0$, when a grayscale value difference $\Delta G=G_p(n)-f(n)\times G_p(n)>\Delta G_0$, the image processing unit calculates the $G'_p(n)$ by the following formula:

$$G'_p(n)=G_p(n)-\Delta G_0.$$

Figure 4:
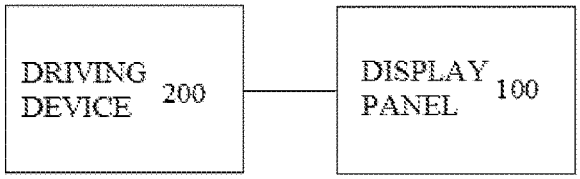
FIG. 4 is a schematic view of a display device provided in one embodiment of the present disclosure.

The present disclosure further provides a display device. With reference to FIG. 4, the display device includes a driving device 200 and a display panel 100. The driving device 200 provides driving signals to the display panel 100 to drive the display panel 100 to display image. The driving device 200 is the driving device mentioned in the above embodiment. The display device may be a LCD or an OLED.

As shown in the above mentioned driving method and driving device provided in the embodiment, the pixel grayscale values are respectively calculated. When an average value of the grayscale values, a variance of the grayscale values, and a root-mean-square-error of the grayscale value of the current frame being relative to the grayscale value of the driving data of a pervious frame of one of the display areas are respectively greater than thresholds, the grayscale values of the sub-pixels of the one of the display areas are respectively adjusted by the downgrade adjustment. The luminance of some of the or all of the display areas is selectively reduced while the image observed by the human eye is not affected, and the power consumption is reduced As shown in the above mentioned driving method and driving device provided in the embodiment, when the display device is an OLED display, not only the power consumption may be reduced, but also the life time of the OLED may be extended.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving method of display devices, comprising:

dividing received image data of a frame into a plurality of display areas;

respectively adjusting pixel grayscale values of each of the plurality of display areas of the current frame to change the pixel grayscale values of multiple ones or all of the plurality of display areas from first values to second values that are smaller than the first values;

combining all of the display areas after adjusting the pixel grayscale values to form driving data of the current frame; and outputting the driving data of the current frame to drive the current frame to be displayed; and further comprising:

setting all of sub-pixels of an n-th display area of the current frame as a set;

calculating an average value $G_a(n)$ of the grayscale values in the set;

calculating a variance $G_v(n)$ of the grayscale values in the set;

calculating a root-mean-square-error R(n) of the grayscale value of the current frame being relative to the grayscale value of the driving data of a previous frame;

when $G_a(n) \geq G_{ath}$, $G_v(n) \geq G_{vth}$, and $R(n) \geq R_{th}$, changing the pixel grayscale values of the n-th display area from the first values to the second values that are smaller than the first values;

wherein $G_{ath}$ is a threshold of the average value of the grayscale values;

wherein $G_{vth}$ is a threshold of the variance of the grayscale values;

wherein $R_{th}$ is a threshold of the root-mean-square-error of the grayscale values;

wherein n is a positive integer;

wherein when the current frame is the first frame being inputted, the grayscale value of the driving data of a previous frame is set as 0.

2. The driving method of the display as claimed in claim 1, further comprising:

adjusting the pixel grayscale value of the n-th display area by the following formula:

$$G'p(n)=f(n)\times G_p(n);$$

wherein $G_p(n)$ is the pixel grayscale value before adjustment;

wherein $G'_p(n)$ is the pixel grayscale value after adjustment;

wherein f(n) is an adjustment coefficient of the n-th display area;

wherein when $G_a(n) \geq G_{ath}$, $G_v(n) \geq G_{vth}$, and $R(n) \geq R_{th}$, $0<f(n)<1$; otherwise $f(n)=1$.

3. The driving method of the display as claimed in claim 2, wherein when $0<f(n)<1$, f(n) is a constant or an inversely proportional function related to the average value $G_a(n)$.

4. The driving method of the display as claimed in claim 2, further comprising:

setting an adjustment threshold $\Delta G_0$;

when a grayscale value difference $\Delta G=G_p(n)-f(n)\times G_p(n) > \Delta G_0$, calculating $G'_p(n)$ by the following formula:

$$G'_p(n)=G_p(n)-\Delta G_0.$$

5. The driving method of the display as claimed in claim 3, wherein the display areas comprise:

a central area, located on a central position of a displayed image; and a plurality of rim areas, located around the central area;

wherein a dimension of the central area is more than 50% of a dimension of the displayed image.

6. The driving method of the display as claimed in claim 4, wherein the display areas comprise:

a central area, located on a central position of a displayed image; and a plurality of rim areas, located around the central area;

wherein a dimension of the central area is more than 50% of a dimension of the displayed image.

* * * * *